US005570949A

United States Patent [19]

Chiang

[11] Patent Number: 5,570,949

[45] Date of Patent: Nov. 5, 1996

[54] TORCH WITH A BELLOWED INTERMEDIATE FLEXIBLE HOSE MEMBER

[76] Inventor: Hanh Chiang, No. 162, Chung-Cheng S. Rd., Hsin-Ying Hsiang, Tainan Hsien, Taiwan

[21] Appl. No.: 580,942

[22] Filed: Dec. 29, 1995

[51] Int. Cl.[6] ..... F21L 7/00

[52] U.S. Cl. ..... 362/198; 362/157; 362/205

[58] Field of Search ..... 362/157, 194, 362/198, 202, 205, 418

[56] References Cited

U.S. PATENT DOCUMENTS

| | | | |
|---|---|---|---|
| 3,103,723 | 9/1963 | Becker | 362/198 X |
| 4,443,831 | 4/1984 | Godfrey et al. | 362/198 X |
| 4,733,337 | 3/1988 | Bieberstein | 362/202 X |

*Primary Examiner*—Stephen F. Husar
*Attorney, Agent, or Firm*—Foley & Lardner

[57] ABSTRACT

A torch includes a head member with a bulb unit, a tail member with a cell unit, and a bellowed intermediate flexible hose member threadedly connected to the head and tail members. The head member includes an on-off switch for energizing the bulb unit upon actuation. The hose member includes a hose body, two connectors respectively attached to two ends of the hose body, and front and rear conductive contact sets respectively provided in the connectors in such a manner that the front conductive set is in electrical contact with the bulb unit while the rear conductive set is in electrical contact with terminals of the cell unit. Each of the front and rear conductive sets includes an insulated tubular holding seat fixed within the corresponding connector and provided with a reduced-diameter outer end portion, an annular conductive ring sleeved around the outer end portion, a conductive mushroom-like contact element press-fitted within the end portion of the seat. A central wire extends through the hose body and the corresponding seat and has an outer end extended into the blind hole of a corresponding element so as to establish an electrical connection. A peripheral wire extends through the hose body and the seat to be in electrical contact with the ring. The ring and the element serves as two electrical contacts.

2 Claims, 6 Drawing Sheets

TORCH WITH A BELLOWED INTERMEDIATE FLEXIBLE HOSE MEMBER

BACKGROUND OF THE INVENTION

1. Field of the Invention

The invention relates to a torch, more particularly to a torch with a bellowed intermediate flexible hose member.

2. Description of the Related Art

Referring to FIGS. 1 and 2, a conventional torch 10 is shown to include a head member 12, a tail member 13, and a bellowed intermediate flexible hose member 11. As illustrated, the flexible hose member 11 includes a hose body 111, first and second wires 15 disposed within the hose body 111, and two conductive plug sets 161 respectively provided on two opposite end portions of the wires 15. Each of the head and tail members 12, 13 has two socket sets 171 connected electrically to a corresponding one of a bulb unit on the head member 12 and a cell unit in the tail member 13 by means of wires 17. In assembly, the plug sets 161 of the hose member 11 are inserted into the socket sets 171 of the head and tail members 12, 13. Then, the hose member 11 is attached to both the head and tail members 12, 13 by rivets 19 so as to fix the head and tail members 12, 13 on the end portions of the hose member 11.

The head and tail members 12, 13 cannot be easily removed from the hose member 11 so that in case of disengagement of the plug and socket sets 161, 171 or breakage of wires 17, the torch becomes useless.

SUMMARY OF THE INVENTION

The object of this invention is to provide a torch which includes head and tail members, and a flexible hose member that can be easily removed from one another, thereby assisting in the replacement of a damaged part in the torch.

Accordingly, the torch of this invention includes a head member, a tail member, and a bellowed intermediate flexible hose member. The head member includes an externally threaded rear end section, a bulb unit disposed therein, and an on-off switch which is mounted on the head member and which can energize the bulb unit upon actuation. The tail member includes an externally threaded front end section, and a cell unit for supplying power to the bulb unit. The hose member includes a hose body, two connectors which are respectively attached to two ends of the hose body and which respectively have internally threaded end sections engaging threadedly the externally threaded end sections of the head and tail members, front and rear conductive contact sets respectively provided in the connectors in such a manner that the front conductive set is in electrical contact with the bulb unit while the rear conductive set is in electrical contact with terminals of the cell unit. Each of the front and rear conductive sets includes an insulated tubular holding seat fixed within the corresponding connector and provided with a reduced-diameter outer end portion, an annular conductive ring sleeved around the outer end portion of the seat, a central opening through the outer end portion of the seat, and a conductive mushroom-like contact element press-fitted within the outer end portion of the seat. Each of the elements has a small-diameter portion extending into the outer end portion of the seat and a large-diameter portion exposed partially to an exterior of the seat. A central wire extends through the hose body and the seat and has an outer end attached removably to the small-diameter end portion of the element so as to contact electrically therewith. A peripheral wire extends through the hose body and the seat so as to be in electrical contact with an inner peripheral surface of the ring. The ring and the element serve as two contacts.

Since the head and tail members can be easily removed from the hose member, replacement of a damage in the torch of this invention is facilitated.

BRIEF DESCRIPTION OF THE DRAWINGS

Other features and advantages of this invention will become more apparent in the following detailed description of the preferred embodiment with reference to the accompanying drawings, in which.

DETAILED DESCRIPTION OF THE PREFERRED EMBODIMENT

Figure 1:
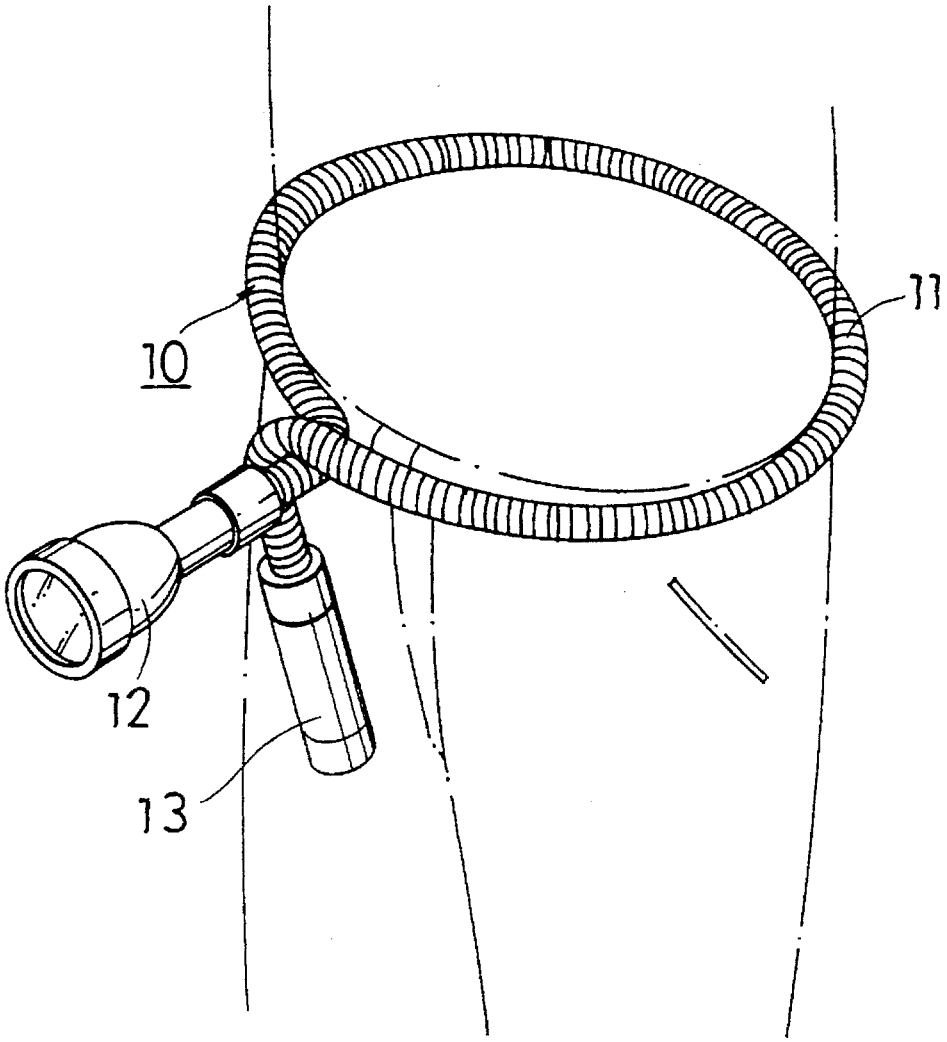
FIG. 1 PRIOR ART
FIG. 1 illustrates how a conventional torch is wrapped around a user's waist.
Figure 2:
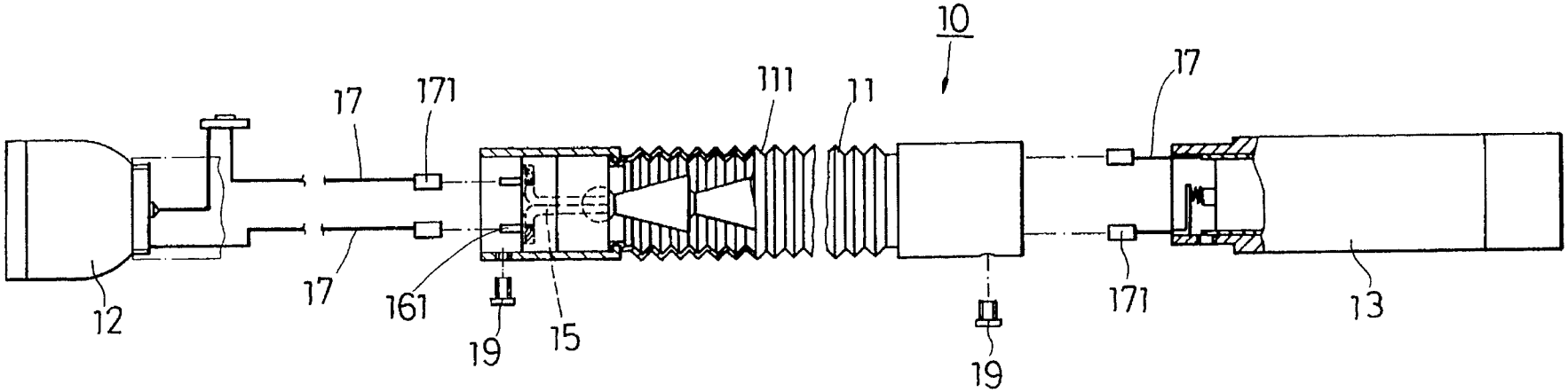
FIG. 2 PRIOR ART
FIG. 2 is an exploded view of the conventional torch shown in FIG. 1.
Figure 3:
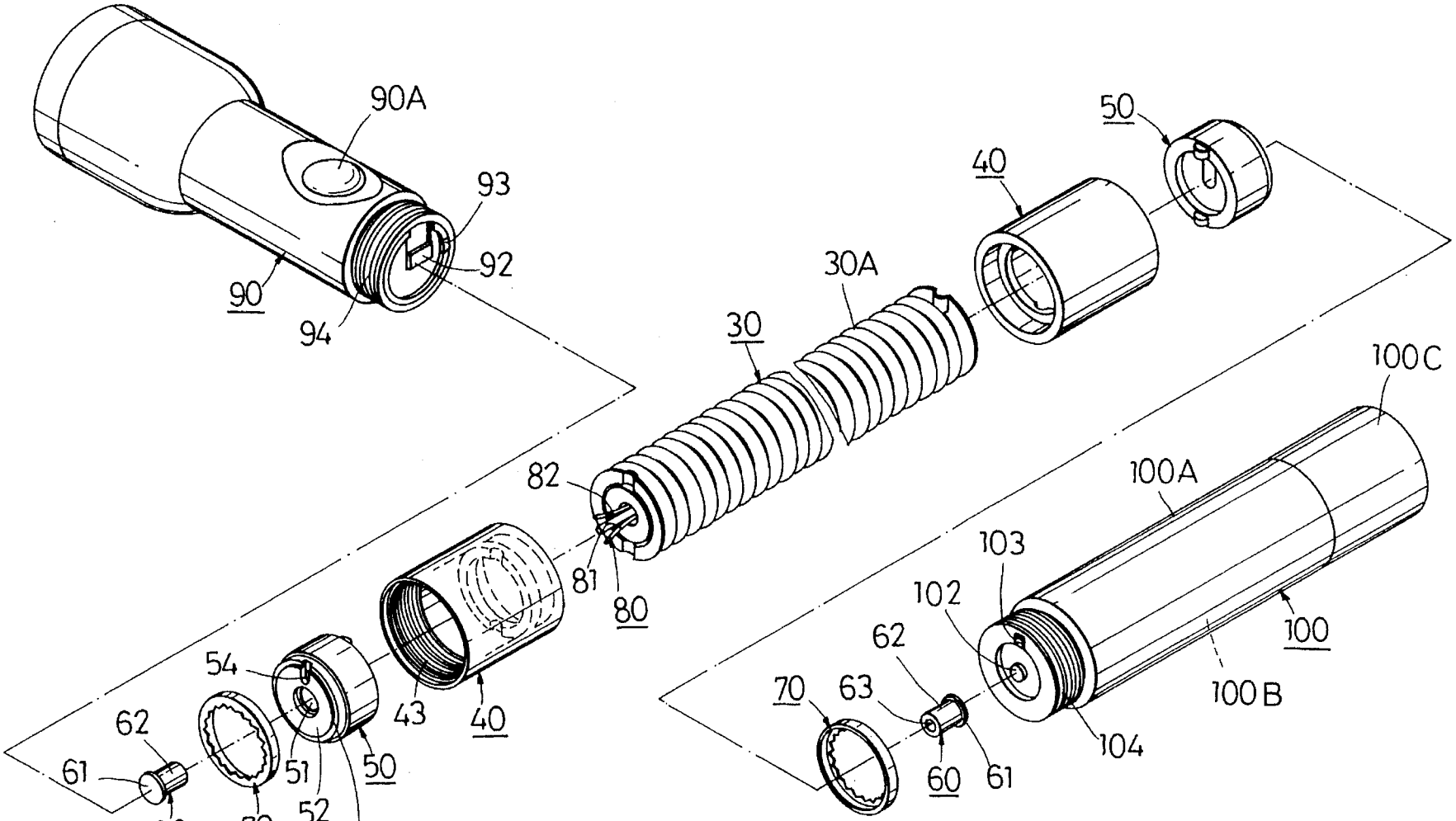
FIG. 3 is an exploded view of a torch of this invention.
Figure 4:
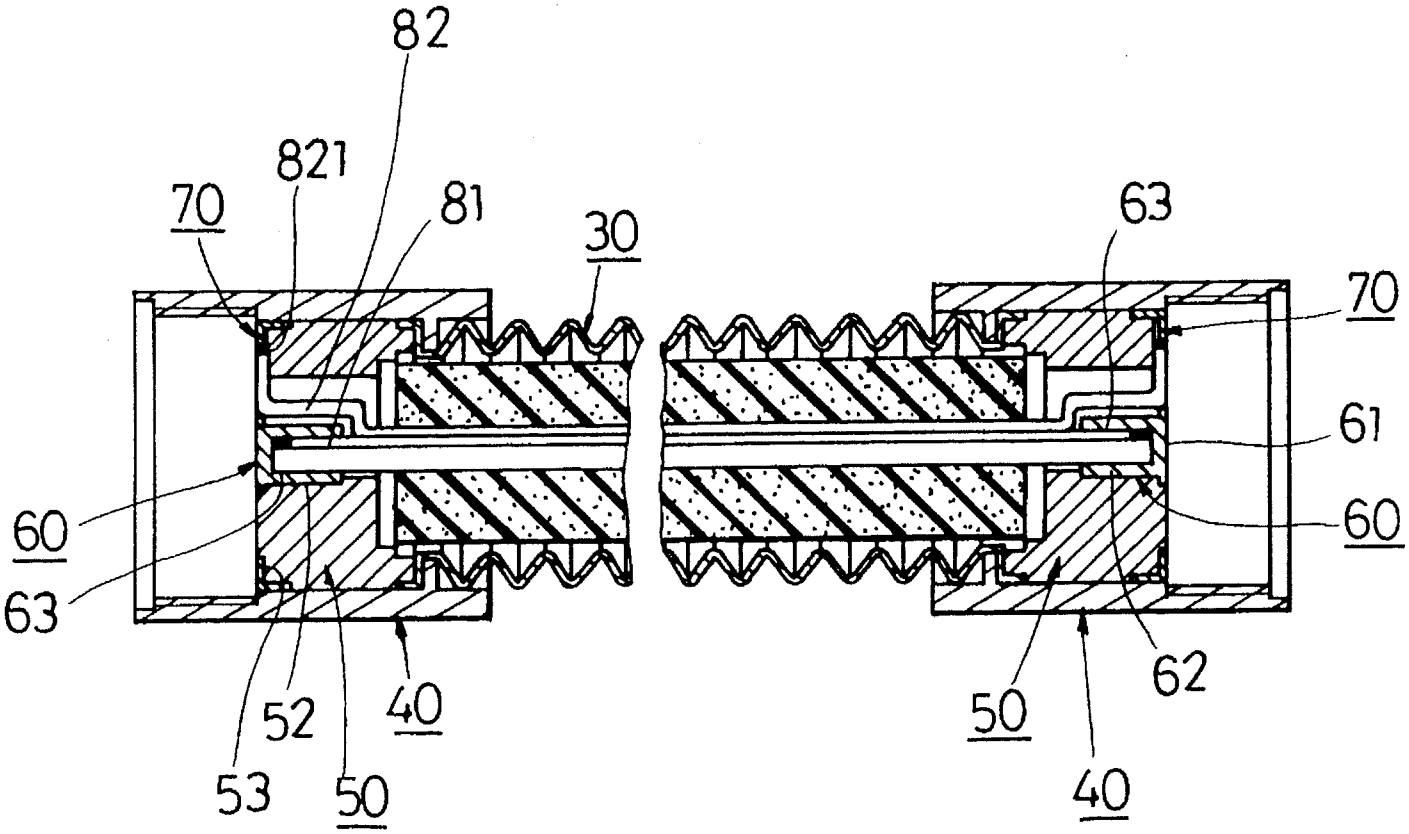
FIG. 4 is a partially sectioned view of a flexible hose member of the torch of this invention.
Figure 5:
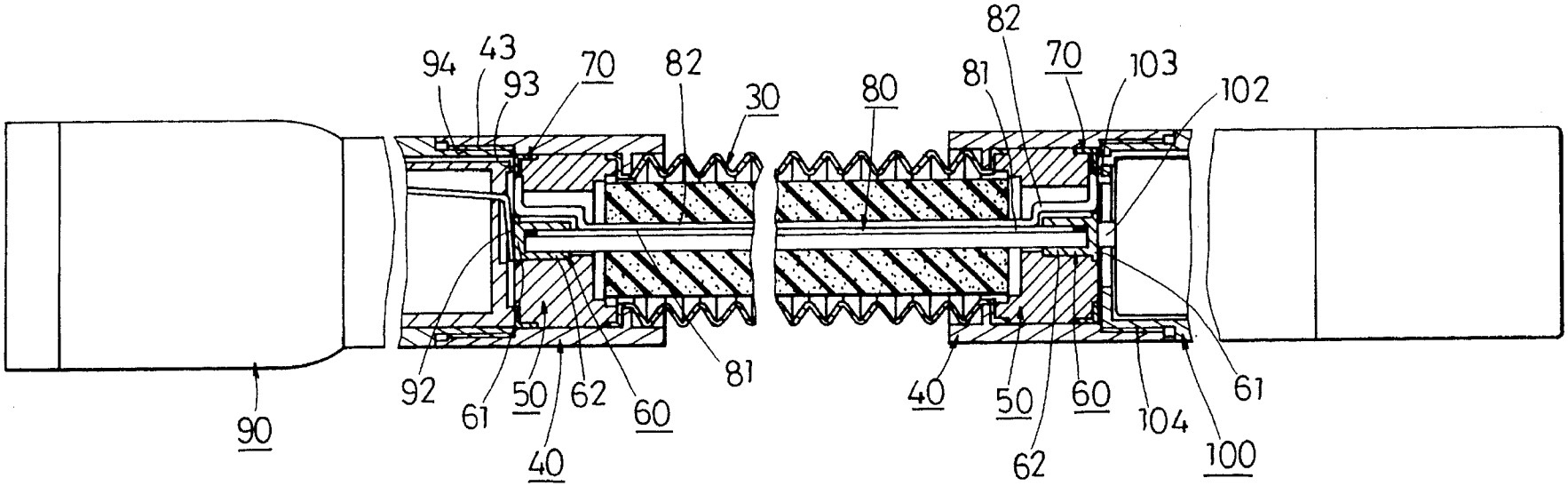
FIG. 5 is a partially sectioned view of a portion of the torch of this invention.

Referring to FIGS. 3, 4 and 5, a torch of this invention includes a head member 90, a tail member 100, and a bellowed intermediate flexible hose member 30.

As illustrated, the head member 90 includes an externally threaded rear end section 94, a bulb unit disposed therein (not visible), and an on-off switch 90A which is mounted on the head member 90 and which can energize the bulb unit upon actuation.

The tail member 100 includes a barrel portion 100A which receives a cell unit 100B therein, and a cap unit 100C mounted detachably on a rear end section of the barrel portion 100A. The barrel portion 100A has an externally threaded front end section 104, and an elongated conductive stick (not visible) disposed therein which has a front terminal 103 exposed outwardly from the front end section 104 of the barrel portion 100A.

The hose member 30 includes a hose body 30A, two hollow tubular connectors 40 respectively attached to two ends of the hose body 30A and respectively having internally threaded end sections 43 engaging threadedly the externally threaded end sections 94, 104 of the head and tail members 90, 100, and front and rear conductive contact sets respectively provided in the connectors 40. Each of the front and rear conductive sets includes an insulated tubular holding seat 50 fixed within the corresponding connector 40 and provided with a reduced-diameter outer end portion 53, an annular conductive ring 70 sleeved around the outer end portion 53, a central hole 51 formed through the outer end wall 52 of the seat 50, a conductive mushroom-like contact element 60 press-fitted within the central hole 51 of the seat 50. Each of the elements 60 has a large-diameter outer end portion 61 exposed partially to an exterior of the seat 50, and a small-diameter portion 62 extending into the central hole 51 of the seat 50. A central wire 81 extends through the hose body 30A and the seat 50 and has an outer conductive end disposed removably in a blind hole 63 formed in an end surface of the small-diameter portion 62 of the element 60 so as to establish an electrical connection therebetween. A peripheral wire 82 extends through the hose body 30A and the peripheral opening 54 of the seat 50 so as to be in electrical contact with an inner peripheral surface of the ring 70. The ring 70 and the element 60 therefore serve as two electrical contacts. Thus, the front conductive set 60, 70 is in electrical contact with two terminals 92, 93 of the bulb unit while the rear conductive set 60, 70 is in electrical contact with terminals 102, 103 of the cell unit 100B.

Figure 6:
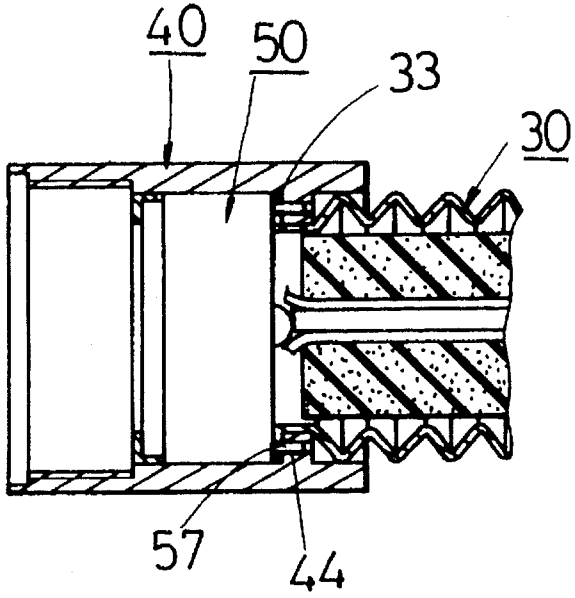
FIG. 6 is a sectional view of a portion of the torch of this invention.

As shown in FIG. 6, each of the seats 50 has a pair of integral locking pins 57 extending through the holes 33 of the annular flange of the flexible hose member 30 and into the hole 44 of the inwardly projecting flange of the connector 40 so as to prevent disengagement of the hose member 30 from the connectors 40.

In the event, the bulb in the torch of this invention is damaged, the head and tail members 90, 100 can be easily removed from the hose member 30, thereby assisting in replacement of a new bulb.

With this invention thus explained it is obvious to those skilled in the art that various modifications and variations can be made without departing from the spirit and scope of this invention. It is therefore intended that this invention be limited only as in the appended claims.

I claim:

1. A torch comprising:

a head member including an externally threaded rear end section, a bulb unit disposed therein, and an on-off switch which is mounted on said head member and which is capable of energizing said bulb unit upon actuation;

a tail member including an externally threaded front end section, and a cell unit for supplying power to said bulb unit; and a bellowed intermediate flexible hose member including a hose body, two connectors respectively attached to two ends of said hose body and respectively having internally threaded end sections engaging threadedly said externally threaded end sections of said head and tail members, front and rear conductive contact sets respectively provided in said connectors in such a manner that said front conductive set is in electrical contact with said bulb unit while said rear conductive set is in electrical contact with terminals of said cell unit, wherein each of said front and rear conductive sets includes an insulated tubular holding seat fixed within a corresponding one of said connectors and provided with a reduced-diameter outerend portion, an annular conductive ring sleeved around said outer end portion, an opening formed in the outer end portion of said seat, a conductive mushroom-like contact element press-fitted within said outer end portion of said seat and having a small-diameter portion extending into said outer end portion of said seat and a large-diameter outer end portion exposed partially to an exterior of said seat, a central wire extending through said hose body and said seat and having an outer end attached removably to said small-diameter portion of said element so as to establish an electrical connection therebetween, a peripheral wire extending through said hose body and said seat to be in electrical contact with an inner peripheral surface of said ring, said ring and said element serving as two contacts.

2. The torch as defined in claim 1, wherein said small-diameter portion of each of said elements has an end surface formed with a blind hole within which said outer end of a corresponding one of said central wires is press-fitted.

* * * * *